United States Patent [19]

Schneider et al.

[11] 4,333,321

[45] Jun. 8, 1982

[54] KNITWARE STRUCTURE

[75] Inventors: Manfred Schneider; Frank Schubert, both of Karl Marx Stadt, German Democratic Rep.

[73] Assignee: Veb Wirkmaschinenbau Karl-Marx-Stadt, Karl Marx Stadt, German Democratic Rep.

[21] Appl. No.: 126,857

[22] Filed: Feb. 28, 1980

[30] Foreign Application Priority Data

Mar. 4, 1979 [DD] German Democratic Rep. ... 211561

[51] Int. Cl.[3] ..... D04B 23/08; D04B 23/10

[52] U.S. Cl. ..... 66/192; 66/190; 66/191

[58] Field of Search ..... 66/190, 191, 192, 193, 66/194

[56] References Cited

U.S. PATENT DOCUMENTS 3,109,302 11/1963 Vitek ..... 106/191 X

FOREIGN PATENT DOCUMENTS 1455380 11/1976 United Kingdom ..... 66/191

*Primary Examiner*—Ronald Feldbaum

*Attorney, Agent, or Firm*—Michael J. Striker

[57] ABSTRACT

In knitted goods, particularly pile-knit goods, with pile yarn tied into the loops and with weft elements extending at least over two-needle spacings, the pile-forming pile yarns are tied together only in every second course. This may be implemented by tying-in the pile yarns as loop jointly with the meshing yarn while weft yarns and dead piles are preferably tied as weft into the in-between courses. When tying the patterning piles as weft into every second course, dead pile and weft are also ties into these courses, while the in-between course will preferably consist only of the meshing warp yarn.

5 Claims, 3 Drawing Figures

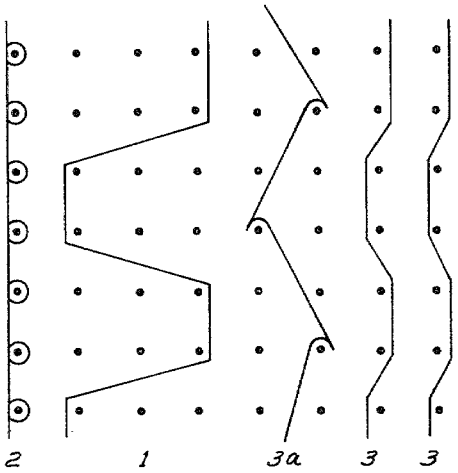
FIG. 2
FIG. 3
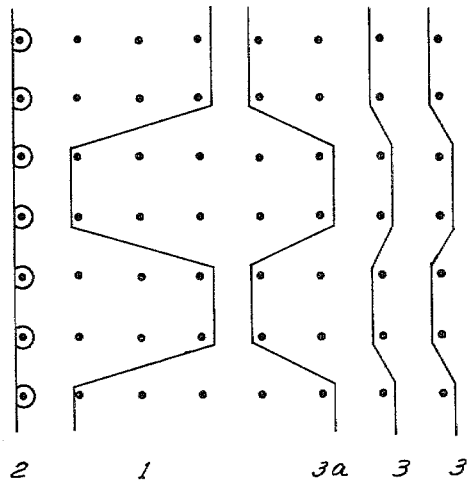

KNITWARE STRUCTURE

BACKGROUND OF THE INVENTION

The invention is applicable to knitted goods, particularly pile-knit goods, with pile yarn tied into the loops of a meshing yarn system, and with weft elements for lateral joining of wales extending over at least two needle gaps.

Prior-art knitting goods have in every course weft yarn, patterning pile yarn and dead pile yarn. The patterning pile yarns are tied herein either as weft or mesh loop into the loops of two adjacent warp wales. (German Letters Pat. Nos. DD 110 073 and DD 20 066). These known knitted goods have disadvantages.

If the patterning pile is tied in as weft (DD No. 20 066) an insufficient quantity of coating liquid will reach the capillaries of the pile yarn when the back of the fabric is being coated. The patterning piles are insufficiently tied to the base fabric and will come loose. The life of such carpets is relatively low.

It is also known how to tie-in the patterning pile as mesh loop (DD No. 110 073). In this instance, the coating liquid will reach the tying point of the patterning pile without difficulties. This construction will, however, require additional pile material for the mesh loop at the right-hand side of the fabric.

SUMMARY OF THE INVENTION

It is an object of the invention to economize on pile material, to improve the quality of the goods, and to simplify coating.

Another object of the invention is to secure firm tying of the patterning pile over the shortest tying-in length, and to make the tying point accessible from the rear of the fabric.

According to the invention, the above objects are attained by tying the respective patterning or pile-forming pile yarns only into every second course of the knitted fabric.

This solution has the advantage that on the one hand the tying points of the pile yarn need not extend around all weft elements and that on the other hand, the additional course will create spaces between, respectively, the weft yarns and the weft elements, through which the coating liquid may reach the typing points. Herein, the patterning pile yarns in every second course may be tied in as loops conjointly with the warp yarn, while in the courses inbetween, the warp yarns will individually enclose at least a portion of the weft yarns or each weft yarn.

In jacquard-patterned pile-knit goods with a plurality of pile yarns per wale, the respective non-patterning pile yarns may also be tied in as standing weft into these in-between courses.

It will be appropriate to tie the above mentioned yarns in an even notation with the weft yarns in order to obtain a flat position of these non-patterning pile yarns. As per a further variant of the invention, the pile-forming pile yarns of every second course are tied as weft in odd notation conjointly with partial-weft yarns, while the in-between courses will preferably consist only of the knit yarn.

It will suit the purpose in the production of a jacquard-patterned pile knit that the non-patterning pile yarns are tied as weft in even notation with the pile-forming pile yarn in that course where the pile-forming pile yarns is tied in.

The advantages of the solution according to this invention consist in the tying-in length of the pile yarn, the patterning pile yarn as well the dead-pile yarn, being reduced to a minimum. The minimum coating requisite for stabilization of the base fabric may concomitantly be utilized for additional fastening of the pile loops.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a schematic of the laying of the fabric of FIG. 1, wherein the pile yarn is tied-in as a loop; and FIG. 3 is a schematic of the laying, wherein the pile yarn is tied-in as weft.

DESCRIPTION OF THE PREFERRED EMBODIMENTS

Figure 1:
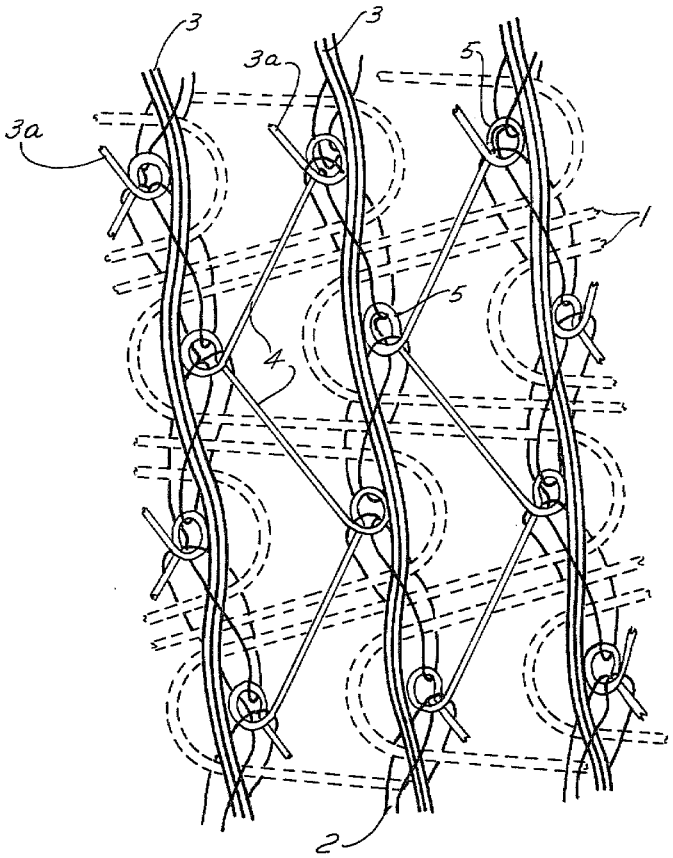
FIG. 1 is a representation of the fabric from the left side.

The fabric has a base fabric, consisting of weft yarns 1 and of mesh warp yarns 2 usually tied in as pillar stitch. Pile yarns 3 are tied into this base fabric in successive courses, whereby pile loops 5 with lugs 4 are formed between two respective tying points of the pile yarns 3 and 3*a*. The tying points may alternate herein between adjacent wales or may also be arranged within one and the same wale.

Non-patterning pile yarns 3, so-called dead pile yarns, are preferably tied as standing weft into one respective wale.

In FIGS. 1 and 2, the respective patterning pile yarn 3*a* is tied jointly with the meshing warp yarn 2 into every second course. During the loop-forming cycle wherein the weft yarns 1 are laid under the needles, the patterning pile yarn 3*a* is inserted into the needle hook and formed into a loop 5. During the subsequent loop-forming cycle all yarn carriers will remain in their position. Only the meshing yarn carrier will insert its meshing warp yarn 2 into the needle. In the subsequent cycle, the weft yarn 1 and the non-patterning pile yarns 3, are tied into the course formed thereupon, preferably by underlapping and in even notation while the patterning pile yarn 3*a* is again formed into a loop. It can be recognized clearly that the course into which no weft yarns are tied in, will have only very small mesh loops, visible at the right-hand side of the fabric. These mesh loops are very firmly tied in and are accessible from the back side of the fabric by any type of coating liquid.

Tying-in of dead pile and weft yarn in even notation has the advantage that, with sufficiently tensioned feed of the dead pile, it will be tied-in nearly flat and limited longitudinal elasticity of the fabric will be achieved thereby. The patterning piles of a pile yarn are thus all arranged within one single row between two wales, ensuring thereby a clear undistorted appearance of the pattern.

FIG. 3 shows the arrangement of the notation of the second variant of the fabric. The weft yarns 1 and a pile yarns 3 are simultaneously underlapped, preferably in opposite notation, into every second course. The tying point of the patterning piles is convered only by the meshing yarn and is thus accessible with certainty to the customary coating liquids.

When producing the fabric according to this invention, attention should be paid that the draw-off length of the material per 100 courses should conform to the requisite pile density and that, in given instances, the draw-off tension of that course into which the mesh loops are tied, is periodically reduced.

In order to tie the dead piles possibly flat into the base fabric it will be appropriate to further elastically tension the pile yarns in their entirety immediately after knocking over.

The invention may be applied to the production of patterned and non-patterned pile knits. It is herein immaterial in which way be weft yarns are guided in, be it as longitudinal weft, diagonal weft, partial weft or in the form of a surface made of a mat, foil, or woven or knitted fabric, which are penetrated by the needle. It is essentially when applying the invention that the flanks of mesh loops of the pile yarn will only partially envelop the weft yarn element located in the warp direction between two mesh loops and that the first named be accessible to coating liquid from the right-hand side of the fabric.

What is claimed as new and desired to be protected by Letters Patent is set forth in the appended claims:

1. Knitted goods, particularly pile-knit goods, comprising a base fabric formed of weft yarn elements and interlooped warp yarns defining therewith wales and courses, said weft yarn elements extending over at least two wales; and pile yarns tied into the loops of the warp yarns and including pile-forming components tied with the warp yarns in every second course and non-patterning components tied as standing weft in one respective wale into the in between courses.

2. Knitted goods as defined in claim 1 wherein said pile-forming components in every second course form a loop jointly with the meshing warp yarn, and the courses of the meshing warp yarn lying in between envelope at least a portion of the weft yarn elements.

3. Knitted goods as defined in claim 2 wherein said non-patterning pile yarn components and said weft yarn elements are tied together in a uniform pattern.

4. Knitted goods as defined in claim 1 wherein said pile-forming components in every second course underlay in a weft-like manner the meshing warp yarns and a part of said weft yarn elements in the same course being tied by the meshing warp yarns at an opposite place; and the in between courses are formed of the meshing warp yarns.

5. Knitted goods as defined in claim 3 wherein the non-patterning pile yarn components are tied as standing weft in the courses including the tied-in pile-forming components of the pile yarn.

* * * * *